US005421298A

United States Patent [19]

Ming et al.

[11] Patent Number: 5,421,298

[45] Date of Patent: Jun. 6, 1995

[54] OUTBOARD MOTOR INCLUDING EASY WITHDRAWAL AND INSERTION OF CAMSHAFT AND ROCKER ARM SUPPORT SHAFT

[75] Inventors: Lam H. Ming, Tsing Yi Island; Chu K. Ying, Yuen Long, both of Hong Kong

[73] Assignee: Outboard Marine Corporation, Waukegan, Ill.

[21] Appl. No.: 253,926

[22] Filed: Jun. 3, 1994

[51] Int. Cl.[6] ..... F02F 7/00

[52] U.S. Cl. ..... 123/193.5; 123/198 E; 123/195 P; 123/198 C; 123/196 W; 123/90.27; 440/900

[58] Field of Search ..... 123/90.27, 90.31, 90.34, 123/90.6, 193.5, 195 R, 195 P, 198 C, 198 E, 196 W, 54.4, 54.6, 58.1, 59.7; 440/88, 900

[56] References Cited

U.S. PATENT DOCUMENTS

| | | | |
|---|---|---|---|
| 4,493,661 | 1/1985 | Iwai | 123/195 P |
| 4,562,797 | 1/1986 | Suzuki | 123/90.34 |
| 4,621,595 | 11/1986 | Suzuki | 440/900 |
| 5,163,394 | 11/1992 | Koishikawa et al. | 123/196 W |
| 5,215,164 | 6/1993 | Shibata | 123/196 A |
| 5,309,877 | 5/1994 | Shigedomi et al. | 123/195 P |

*Primary Examiner*—Henry C. Yuen

*Assistant Examiner*—Weilun Lo

*Attorney, Agent, or Firm*—Michael, Best & Friedrich

[57] ABSTRACT

Disclosed herein is an outboard motor comprising a cylinder block having a horizontally extending lower mounting surface and a rearwardly located vertically extending cylinder head mounting surface, a cylinder head fixed to the cylinder head mounting surface, extending rearwardly from the cylinder block, and including a bottom wall portion having therein a rocker arm support shaft aperture and a camshaft aperture, a camshaft supported vertically and horizontally in the cylinder head about an axis located rearwardly of the cylinder head mounting surface, a rocker arm support shaft supported vertically and horizontally in the cylinder head about an axis located rearwardly of the cylinder head mounting surface, and a lower unit including a driveshaft housing supporting a propeller fixed to the cylinder block lower mounting surface and including an upper rearward profile located forwardly of the camshaft aperture and the rocker arm support shaft aperture and extending so as to enable, when the housing is fixed to the cylinder block, insertion and withdrawal of the rocker arm support shaft through the rocker arm support shaft aperture in the bottom wall portion of the cylinder head and insertion and withdrawal of the camshaft through the camshaft aperture in the bottom wall portion of the cylinder head.

20 Claims, 2 Drawing Sheets

OUTBOARD MOTOR INCLUDING EASY WITHDRAWAL AND INSERTION OF CAMSHAFT AND ROCKER ARM SUPPORT SHAFT

BACKGROUND OF THE INVENTION

The invention relates generally to outboard motors, and more particularly, to outboard motors including a driveshaft housing which, at the lower end, rotatably supports a propeller, and which, at the upper end, fixedly supports a four stroke internal combustion engine. As is well known, such engines include a cylinder head which, in part, defines a camcase containing a camshaft and a rocker arm support shaft.

In the past, removal of the camshaft or the rocker arm support shaft for inspection and/or replacement or for other reasons, was excessively expensive and involved substantial disassembly of the outboard motor.

SUMMARY OF THE INVENTION

The invention provides an outboard motor comprising a cylinder block having a horizontally extending lower mounting surface and a rearwardly located vertically extending cylinder head mounting surface, a cylinder head fixed to the cylinder head mounting surface, extending rearwardly from the cylinder block, and including a bottom wall portion having therein a camshaft aperture, a camshaft supported vertically and horizontally in the cylinder head about an axis located rearwardly of the cylinder head mounting surface, and a lower unit including a driveshaft housing supporting a propeller and fixed to the cylinder block lower mounting surface and including an upper rearward profile located forwardly of the camshaft aperture and extending so as to enable, when the housing is fixed to the cylinder block, insertion and withdrawal of the camshaft through the camshaft aperture in the bottom wall portion of the cylinder head.

The invention also provides an outboard motor comprising a cylinder block having a horizontally extending lower mounting surface and a rearwardly located vertically extending cylinder head mounting surface, a cylinder head fixed to the cylinder head mounting surface, extending rearwardly from the cylinder block, and including a bottom wall portion having therein a rocker arm support shaft aperture, a rocker arm support shaft supported vertically and horizontally in the cylinder head about an axis located rearwardly of the cylinder head mounting surface, and a lower unit including a driveshaft housing supporting a propeller and fixed to the cylinder block lower mounting surface and including an upper rearward profile located forwardly of the rocker arm support shaft aperture and extending so as to enable, when the housing is fixed to the cylinder block, insertion and withdrawal of the rocker arm support shaft through the rocker arm support shaft aperture in the bottom wall portion of the cylinder head.

The invention also provides an outboard motor comprising a cylinder block having a horizontally extending lower mounting surface and a rearwardly located vertically extending cylinder head mounting surface, a cylinder head fixed to the cylinder head mounting surface, extending rearwardly from the cylinder block, and including a bottom wall portion having therein a rocker arm support shaft aperture and a camshaft aperture, a camshaft supported vertically and horizontally in the cylinder head about an axis located rearwardly of the cylinder head mounting surface, a rocker arm support shaft supported vertically and horizontally in the cylinder head about an axis located rearwardly of the cylinder head mounting surface, and a lower unit including a driveshaft housing supporting a propeller and fixed to the cylinder block lower mounting surface and including an upper rearward profile located forwardly of the camshaft aperture and the rocker arm support shaft aperture and extending so as to enable, when the housing is fixed to the cylinder block, insertion and withdrawal of the rocker arm support shaft through the rocker arm support shaft aperture in the bottom wall portion of the cylinder head and insertion and withdrawal of the camshaft through the camshaft aperture in the bottom wall portion of the cylinder head.

The invention also provides an outboard motor comprising a cylinder block having a horizontally extending lower mounting surface and a rearwardly located vertically extending cylinder head mounting surface, a cylinder head comprising a one-piece member fixed to the cylinder head mounting surface, extending rearwardly from the cylinder block, and including a bottom wall portion which has therein a rocker arm support shaft aperture and a camshaft aperture, and which includes a lower surface, spaced upper and central cylindrical bearings vertically aligned with the camshaft aperture, and spaced upper, central, and lower openings vertically aligned with the rocker arm support shaft aperture, a camshaft supported vertically and rotationally in the one-piece cylinder head member about an axis located rearwardly of the cylinder head mounting surface and including vertically spaced upper and central cylindrical bearing surfaces engaged with the upper and central bearings in the one-piece cylinder head member, and a lower end having a lower cylindrical bearing surface and a horizontal surface, a rocker arm support shaft supported vertically and horizontally in the cylinder head about an axis located rearwardly of the camshaft axis and engaged with the upper, central, and lower openings in the one-piece cylinder head member, an oil pump fixed to the lower surface of the cylinder head bottom wall portion and including an upper surface having a portion engaging the rocker arm support shaft for vertical support thereof in the cylinder head, and a boss extending upwardly from the upper surface and into the camshaft aperture in the bottom wall portion of the cylinder head and including a socket which receives the lower end of the camshaft and which includes a cylindrical bearing rotatably engaging the lower cylindrical bearing surface of the camshaft, and a horizontal surface engaging the lower end horizontal surface of the camshaft for vertical support of the camshaft, and a lower unit including a driveshaft housing supporting a propeller and comprising an upper portion including a cylinder block mounting surface fixed to the lower mounting surface of the cylinder block and having a rearward end, a lower portion spaced below the upper portion and having a rearward end located in rearwardly spaced relation from the rearward end of the cylinder block mounting surface and in vertically spaced relation from the cylinder block mounting surface, and a rearward profile extending between the rearward ends of cylinder block mounting surface and the lower portion and located forwardly of the camshaft aperture and the rocker arm support shaft aperture to thereby define an open area rearwardly of the profile and between the bottom wall of the cylinder head and the rearward end of the lower portion of the housing, the vertical and horizontal spacing of the rearward end of the lower portion of the housing and the profile enabling, when the housing is fixed to the cylinder block, insertion and withdrawal of the rocker arm support shaft through the rocker arm support shaft aperture in the bottom wall portion of the cylinder head and insertion and withdrawal of the camshaft through the camshaft aperture in the bottom wall portion of the cylinder head.

Other features and advantages of the invention will become apparent to those skilled in the art upon review of the following detailed description, claims, and drawings.

THE DRAWINGS

Figure 2:
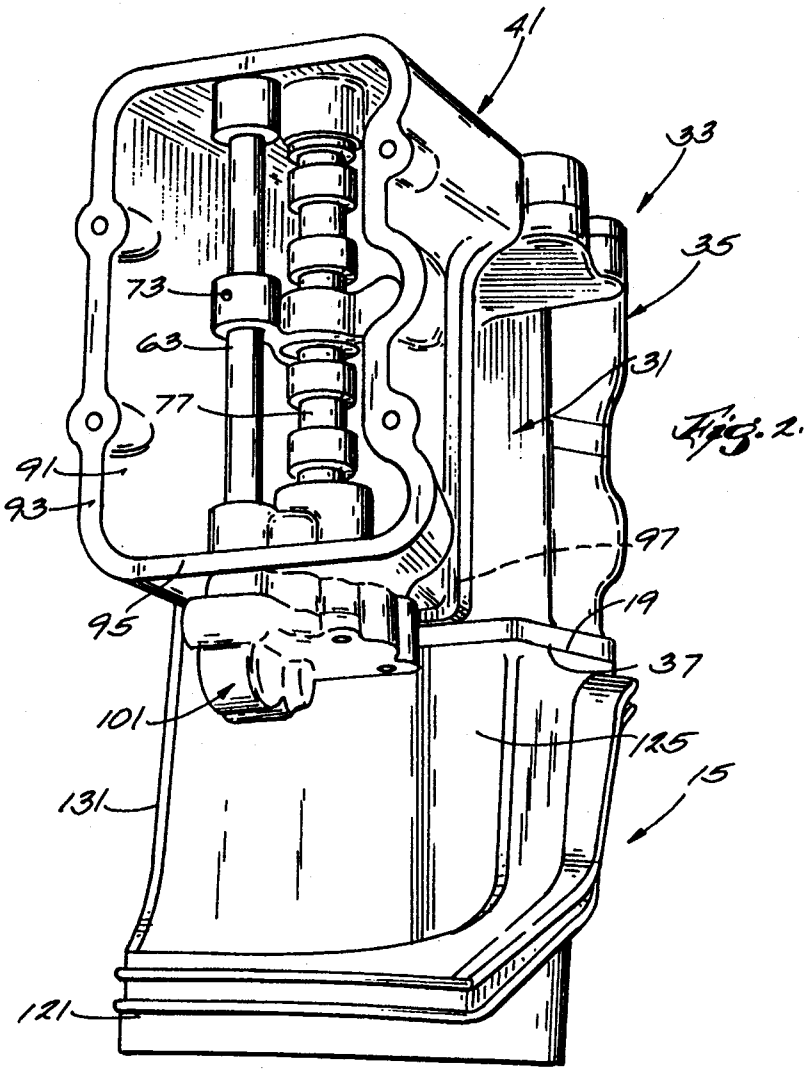
FIG. 2 is an enlarged perspective view of certain of the components included in the outboard motor shown in FIG. 1.
Figure 1:
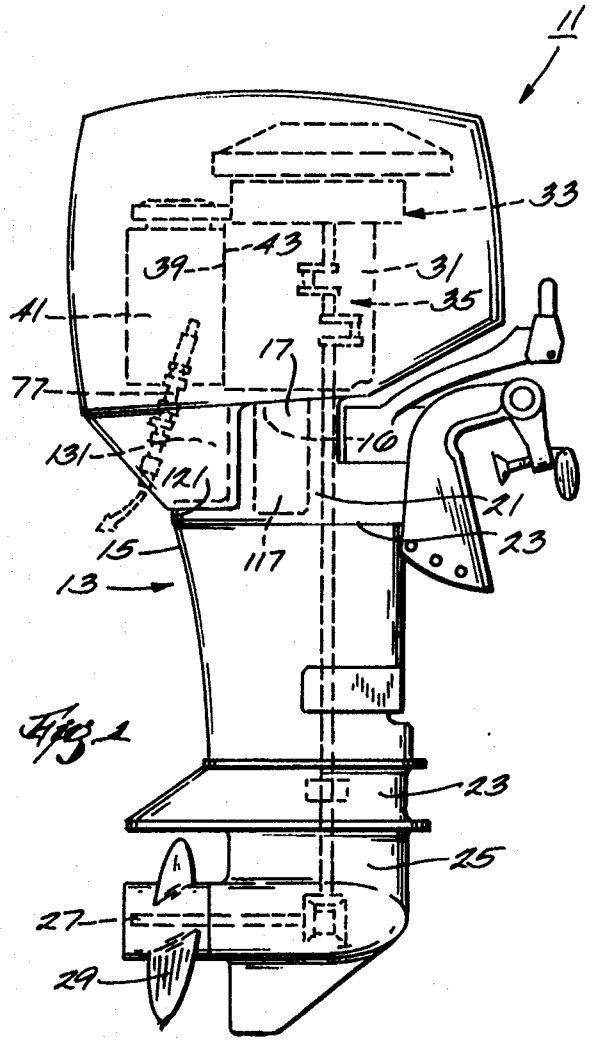
FIG. 1 is an elevational view of an outboard motor incorporating various of the features of the invention.
Figure 4:
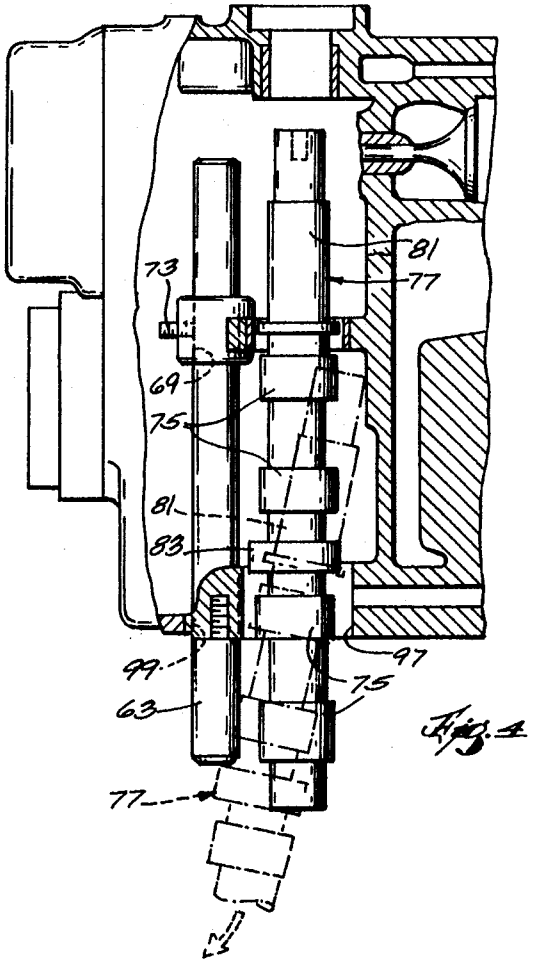
FIG. 4 is a view similar to FIG. 3 illustrating removal from and insertion into the camcase of the cam shaft and rocker arm supporting shaft of the outboard motor shown in FIG. 1.
Figure 3:
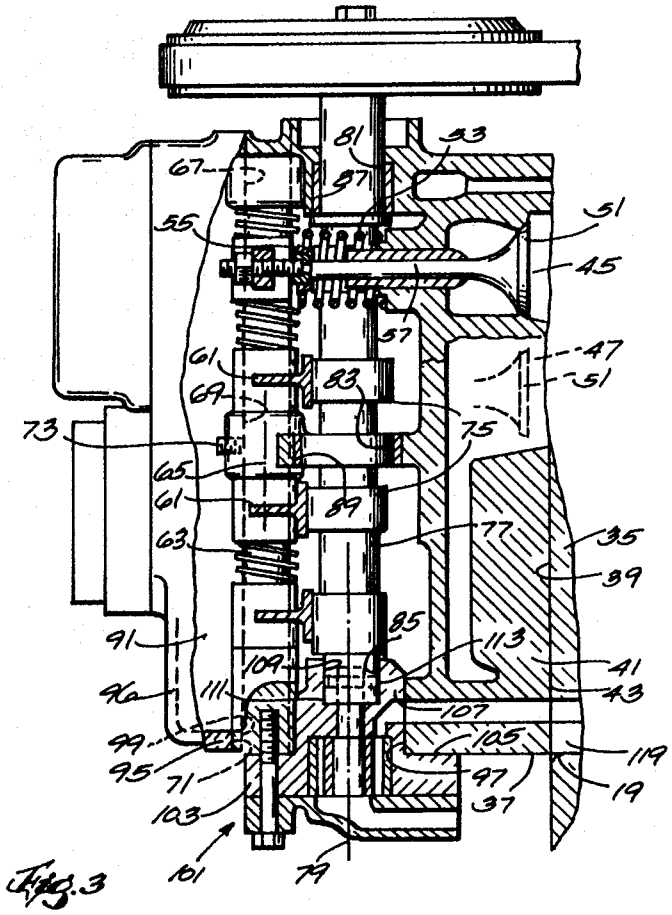
FIG. 3 is an elevational view, partially broken away in section, of various of the components included in the outboard motor shown in FIG. 1.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is an outboard motor 11 which includes a lower unit 13 comprising a drive shaft housing 15 which comprises an upper end 16 including an upper portion 17 which include an upper horizontal mounting surface 19, a lower portion 21, and a lower end 23 located below the lower portion fixed a gear case 25 supporting a propeller shaft 27 carrying a propeller 29.

Fixed to the upper end 16 of the drive shaft housing 15 is a powerhead 31 including a four-stroke internal combustion engine 33 comprising a cylinder block 35 having a lower horizontal mounting surface 37 to which is fixed the upper mounting surface 19 of the drive shaft housing 15. The cylinder block 35 also includes a rearwardly facing vertical cylinder head mounting surface 39 which is suitably attached to a cylinder head including a one-piece cylinder head casting or member 41.

The cylinder head casting or member 41 includes a cylinder block mounting surface 43 which mates with the cylinder head mounting surface 39 of the cylinder block 35 and which includes upper and lower recesses 45 and 47 which define, at least in part, respective combustion chambers (not shown). The recesses 45 and 47 respectively include valve seat surfaces which include an inlet port (not shown) and an exhaust port (not shown) respectively surrounded by an inlet valve seat (not shown) and an exhaust valve seat (not shown).

Supported in the cylinder head (for each cylinder) are inlet and exhaust valves 51 which are respectively linearly movable relative to the inlet and exhaust valve seats to respectively open and close the inlet port and the exhaust port.

The inlet and exhaust valves 51 are biased toward closed positions by suitable respective biasing springs 53 which act between collars 55 on the stems 77 of the associated valves 51 and the cylinder head casting 41.

The inlet and exhaust valves 51 are lifted off the respective valve seats to open the inlet and exhaust ports by respective rocker arms 61 which are suitable journalled on a rocker arm support shaft 63 which has a vertically extending axis 65 and which is horizontally supported at its ends and centrally thereof by upper, central, and lower cylindrical surfaces or openings 67, 69 and 71 formed in the one-piece cylinder head casting or member 41. In order to fix the rocker arm support shaft 63 in the cylinder head, one of the rocker arm support shaft openings 67, 69 and 71, the central opening 69 in the disclosed construction, can, if desired, be provided with a fastening element which can be in the form of a set crew 73 and which is engaged with the rocker arm support shaft to prevent movement thereof.

The rocker arms 61 are pivotally displaced about the axis 65 of the rocker arm support shaft 63 by respective cams 75 provided on a camshaft 77 which has a vertically extending axis 79, which includes vertically spaced upper, intermediate or central, and lower cylindrical bearing surfaces 81, 83 and 85, respectively, and which is rotatably supported adjacent the upper end thereof and centrally thereof by suitable cylindrical bearings or journals 87 and 89 which are formed in the one-piece cylinder head casting or member 41, and which respectively engage the intermediate or central and upper bearing surfaces 81 and 83 of the camshaft 77.

The camshaft 77 is located less rearwardly than the rocker arm support shaft 73 and both are located in a camcase or chamber 91 formed, in part, by a peripheral wall 93 forming a part of the cylinder head casting 41 and by a camcase cover 96 which is fixed to the cylinder head casting or member 41 to complete the camcase 91. The peripheral wall 93 includes a horizontal bottom wall portion 95 which is provided with a camshaft entry opening or aperture 97 and with a rocker arm support shaft entry opening or aperture 99 respectively coaxially located with respect to the camshaft axis 79 and the rocker arm support shaft axis 65.

The camshaft 77, at the lower end thereof, is rotationally and vertically supported by an oil pump 101 which is fixed to the lower or under surface of the bottom wall portion 95 and which also vertically supports the rocker arm support shaft 63. More particularly, the oil pump 101 can, except as explained hereinafter, be of any suitable construction and includes a housing or member 103 having an upper surface 105 which engages the flat lower surface of the bottom wall portion 95 and which extends laterally to cover both the camshaft entry aperture 97 and the rocker arm support shaft entry aperture 99. More specifically, the upper surface 105 of the housing 103 extends across and closes the rocker arm support shaft entry opening 99 and engages the lower end of the rocker arm support shaft 63 to provide vertical support therefore.

The oil pump housing or member 103 also includes a boss 107 which extends upwardly from the upper surface 105 and into the camshaft opening or entry aperture 97 and includes an upwardly open socket 109 including a horizontal or lower wall 111 engaging a horizontal surface at the lower end of the camshaft 77 to provide vertical support therefore. The socket 109 also includes a cylindrical bearing surface 113 which engages the lower cylindrical bearing surface 85 of the camshaft 77.

The drive shaft housing 15 includes, as indicated earlier, an upper portion 17 which can be provided by an upper member 115 including an oil sump 117 and which, as already indicated, includes the upper cylinder block mounting surface 19 which is engaged with and affixed to the lower mounting surface 37 of the cylinder block 35. The cylinder block mounting surface 19 terminates rearwardly with a rearward end 119 located adjacent the cylinder head mounting surface 39, and forwardly of the camshaft opening or entry aperture 97 and the rocker arm support shaft opening or entry aperture 99.

The previously mentioned lower portion 21 of the driveshaft housing 15 can be part of the upper member 115 and is located in vertically spaced relation below the cylinder block mounting surface 19 of the upper portion 17 and well above the gear case 25 and includes a rearward end 121 located in horizontally rearwardly spaced relation from the rearward end 119 of the cylinder block mounting surface 19 and in vertically spaced relation from the cylinder block mounting surface 19. Between the rearward end 119 of the cylinder block mounting surface 19 and the rearward end 121 of the lower housing portion 21, the driveshaft housing 15 includes a rearward profile or wall 125 which extends vertically downwardly from the cylinder block mounting surface 19 and then extends rearwardly to the rearward end 121 of the lower portion 21 to thereby define an open area 131 rearwardly of the rearward end 119 of the cylinder block mounting surface 19 and between the bottom wall portion 95 of the cylinder head casting or member 41 and the rearward end 121 of the lower portion 21 of the driveshaft housing 15, which vertical and rearwardly horizontal spacing of the rearward end 121 of the lower portion 21 of the driveshaft housing 15 is such as to enable vertical insertion of the rocker arm support shaft 63 through the rocker arm support opening or shaft aperture 99 in the bottom wall portion 95 of the cylinder head casting or member 41 and to enable vertically inclined partial insertion of the camshaft 77 through the camshaft opening or aperture 99 in the bottom wall portion 95 of the cylinder head member or casting 41, followed by full insertion of the camshaft 77 into vertical orientation in the camcase 93.

In order to facilitate insertion of the camshaft 77 into the camcase 93 of the cylinder head through the entry opening 97 in the bottom wall portion 95, the camshaft 77 is constructed so that the upper cylindrical bearing surface 81 is of lesser diameter than the intermediate or central cylindrical bearing surface 83. In addition, the radius of the intermediate or central bearing surface 83 of the camshaft 77 is greater than the maximum radius of the outer peripheral surface or profile of the cams 75 which are located on the camshaft 77. Thus, the upper portion of the camshaft 77, i.e., the portion above the central cylindrical surface 83, can readily be passed through the opening defined by the intermediate or central cylindrical bearing surface 83 of the one-piece cylinder head casting or member 41.

In addition, in order to facilitate insertion of the camshaft 77 into the camcase 93 of the cylinder head, the camshaft opening or entry aperture 97 is preferably circular and has a diameter greater than the diameter of the intermediate cylindrical bearing surface 83 of the camshaft 77. Preferably, the boss 107 of the oil pump housing 103 is also circular in profile and fits closely into the camshaft entry opening or aperture 97. As already indicated, the boss 107 of the oil pump housing 103 rotatably and vertically supports the camshaft 77. Thus, the lower cylindrical bearing surface 85 of the camshaft 77 is of lesser diameter than the intermediate cylindrical bearing surface 83 of the camshaft 77.

Whenever there is any need for removal of the camshaft 77 or rocker arm support shaft 63 from the camcase 93 in the cylinder head for inspection or repair, the disclosed construction affords such removal by detaching the oil pump 101 from the lower or bottom wall portion 95 of the cylinder head casting or member 41, thereby exposing the camshaft and rocker arm support shaft entry apertures 97 and 99. Because the axis 65 of the rocker arm support shaft 63 is located rearwardly of the rearward ends 119 and 121 of the upper and lower driveshaft housing portions 17 and 21, the rocker arm support shaft 63 can simply be vertically displaced downwardly to remove it from the camcase 93. In the case of the camshaft 77, the camshaft is initially displaced vertically downwardly until the uppermost cam is displaced through the central bearing 89 in the cylinder head member 41. The camshaft 77 is then inclined downwardly and rearwardly to facilitate full removal from the camcase 93 of the cylinder head.

Insertion of the rocker arm supporting shaft 63 and camshaft 77 merely involves reversing the operation already explained.

Various of the features of the invention are set forth in the following claims.

We claim:

1. An outboard motor comprising a cylinder block having a horizontally extending lower mounting surface and a rearwardly located vertically extending cylinder head mounting surface, a cylinder head fixed to said cylinder head mounting surface, extending rearwardly from said cylinder block, and including a bottom wall portion having therein a camshaft aperture, a camshaft supported vertically and horizontally in said cylinder head about an axis located rearwardly of said cylinder head mounting surface, and a lower unit including a driveshaft housing supporting a propeller and fixed to said cylinder block lower mounting surface and including an upper rearward profile located forwardly of said camshaft aperture and extending so as to enable, when said housing is fixed to said cylinder block, insertion and withdrawal of said camshaft through said camshaft aperture in said bottom wall portion of said cylinder head.

2. An outboard motor comprising a cylinder block having a horizontally extending lower mounting surface and a rearwardly located vertically extending cylinder head mounting surface, a cylinder head fixed to said cylinder head mounting surface, extending rearwardly from said cylinder block, and including a bottom wall portion having therein a rocker arm support shaft aperture, a rocker arm support shaft supported vertically and horizontally in said cylinder head about an axis located rearwardly of said cylinder head mounting surface, and a lower unit including a driveshaft housing supporting a propeller and fixed to said cylinder block lower mounting surface and including an upper rearward profile located forwardly of said rocker arm support shaft aperture and extending so as to enable, when said housing is fixed to said cylinder block, insertion and withdrawal of said rocker arm support shaft through said rocker arm support shaft aperture in said bottom wall portion of said cylinder head.

3. An outboard motor comprising a cylinder block having a horizontally extending lower mounting surface and a rearwardly located vertically extending cylinder head mounting surface, a cylinder head fixed to said cylinder head mounting surface, extending rearwardly from said cylinder block, and including a bottom wall portion having therein a rocker arm support shaft aperture and a camshaft aperture, a camshaft supported vertically and horizontally in said cylinder head about an axis located rearwardly of said cylinder head mounting surface, a rocker arm support shaft supported vertically and horizontally in said cylinder head about an axis located rearwardly of said cylinder head mounting surface, and a lower unit including a driveshaft housing supporting a propeller and fixed to said cylinder block lower mounting surface and including an upper rearward profile located forwardly of said camshaft aperture and said rocker arm support shaft aperture and extending so as to enable, when said housing is fixed to said cylinder block, insertion and withdrawal of said rocker arm support shaft through said rocker arm support shaft aperture in said bottom wall portion of said cylinder head and insertion and withdrawal of said camshaft through said camshaft aperture in said bottom wall portion of said cylinder head.

4. An outboard motor in accordance with claim 3 wherein said drive shaft housing includes an upper housing portion including a cylinder block mounting surface fixed to said lower mounting surface of said cylinder block and including a rearward end, and wherein said drive shaft housing also includes a lower portion spaced below said upper portion and having a rearward end located in horizontally rearwardly spaced relation from said rearward end of said cylinder block mounting surface and in vertically spaced relation from said cylinder block mounting surface to thereby define an open area rearwardly of said drive shaft housing and between said bottom wall of said cylinder head and said rearward end of said lower portion of said housing, said vertical and horizontal spacing of said rearward end of said lower portion of said housing being such as to enable said insertion and withdrawal of said camshaft and said rocker arm support shaft.

5. An outboard motor in accordance with claim 4 wherein said rocker arm support shaft aperture is located rearwardly of said rearward end of said lower housing portion, whereby to enable vertical insertion of said rocker arm support shaft into said cylinder head through said rocker arm support shaft aperture.

6. An outboard motor in accordance with claim 3 wherein said bottom wall portion of said cylinder head includes a lower surface and wherein said outboard motor includes an oil pump which is fixed to said lower surface of said cylinder head bottom wall portion and includes an upper surface including portions respectively engaging said camshaft and said rocker arm support shaft for vertical support thereof in said cylinder head.

7. An outboard motor in accordance with claim 6 wherein said cylinder head includes a one-piece member including spaced cylindrical bearings vertically aligned with said camshaft aperture for horizontally and rotationally supporting said camshaft and spaced openings vertically aligned with said rocker arm support shaft aperture for horizontally supporting said rocker arm support shaft.

8. An outboard motor in accordance with claim 7 wherein said camshaft bearings include vertically spaced upper and central bearings and wherein said oil pump includes a lower bearing vertically spaced from said central bearing.

9. An outboard motor in accordance with claim 7 wherein said rocker arm support shaft openings in said one-piece member include vertically spaced upper, central, and lower, openings.

10. An outboard motor in accordance with claim 9 wherein one of said rocker arm support shaft openings includes a fastening element engaged with said rocker arm support shaft to prevent movement thereof.

11. An outboard motor in accordance with claim 6 wherein said camshaft comprises a lower end including a lower cylindrical bearing surface and a lower end surface and wherein said oil pump includes a boss extending into said camshaft aperture in said bottom wall portion of said cylinder head.

12. An outboard motor in accordance with claim 11 wherein said boss includes a socket which receives said lower end of said camshaft and which includes a cylindrical bearing rotatably engaging said lower cylindrical bearing surface of said camshaft, and a horizontal surface engaging said lower end surface of said camshaft for vertical support of said camshaft.

13. An outboard motor in accordance with claim 3 wherein said camshaft includes vertically spaced upper, central, and lower cylindrical bearing surfaces, wherein said upper cylindrical bearing surface has a diameter, and wherein said central cylindrical bearing surface has a diameter greater than said diameter of said upper cylindrical bearing surface.

14. An outboard motor in accordance with claim 13 wherein said central cylindrical bearing surface has a radius and wherein said camshaft includes a cam located between said upper and central cylindrical bearing surfaces and having an outer periphery with a maximum radius less than the radius of said cylindrical central bearing surface.

15. An outboard motor in accordance with claim 13 wherein said camshaft aperture in said bottom wall portion of said cylinder head has a diameter greater than said diameter of said central cylindrical bearing of said camshaft.

16. An outboard motor in accordance with claim 3 wherein said rocker arm support shaft aperture is located rearwardly of said camshaft aperture.

17. An outboard motor comprising a cylinder block having a horizontally extending lower mounting surface and a rearwardly located vertically extending cylinder head mounting surface, a cylinder head comprising a one-piece member fixed to said cylinder head mounting surface, extending rearwardly from said cylinder block, and including a bottom wall portion which has therein a rocker arm support shaft aperture and a camshaft aperture, and which includes a lower surface, spaced upper and central cylindrical bearings vertically aligned with said camshaft aperture, and spaced upper, central, and lower openings vertically aligned with said rocker arm support shaft aperture, a camshaft supported vertically and rotationally in said one-piece cylinder head member about an axis located rearwardly of said cylinder head mounting surface and including vertically spaced upper and central cylindrical bearing surfaces engaged with said upper and central bearings in said one-piece cylinder head member, and a lower end having a lower cylindrical bearing surface and a horizontal surface, a rocker arm support shaft supported vertically and horizontally in said cylinder head about an axis located rearwardly of said camshaft axis and engaged with said upper, central, and lower openings in said one-piece cylinder head member, an oil pump fixed to said lower surface of said cylinder head bottom wall portion and including an upper surface having a portion engaging said rocker arm support shaft for vertical support thereof in said cylinder head, and a boss extending upwardly from said upper surface and into said camshaft aperture in said bottom wall portion of said cylinder head and including a socket which receives said lower end of said camshaft and which includes a cylindrical bearing rotatably engaging said lower cylindrical bearing surface of said camshaft, and a horizontal surface engaging said lower end horizontal surface of said camshaft for vertical support of said camshaft, and a lower unit including a driveshaft housing supporting a propeller and comprising an upper portion including a cylinder block mounting surface fixed to said lower mounting surface of said cylinder block and having a rearward end, a lower portion spaced below said upper portion and having a rearward end located in rearwardly spaced relation from said rearward end of said cylinder block mounting surface and in vertically spaced relation from said cylinder block mounting surface, and a rearward profile extending between said rearward ends of cylinder block mounting surface and said lower portion and located forwardly of said camshaft aperture and said rocker arm support shaft aperture to thereby define an open area rearwardly of said profile and between said bottom wall of said cylinder head and said rearward end of said lower portion of said housing, said vertical and horizontal spacing of said rearward end of said lower portion of said housing and said profile enabling, when said housing is fixed to said cylinder block, insertion and withdrawal of said rocker arm support shaft through said rocker arm support shaft aperture in said bottom wall portion of said cylinder head and insertion and withdrawal of said camshaft through said camshaft aperture in said bottom wall portion of said cylinder head.

18. An outboard motor in accordance with claim 17 wherein said upper cylindrical bearing surface has a diameter, and wherein said central cylindrical bearing surface has a diameter greater than said diameter of said upper cylindrical bearing surface.

19. An outboard motor in accordance with claim 17 wherein said central cylindrical bearing surface has a radius and wherein said camshaft includes a cam located between said upper and central cylindrical bearing surfaces and having an outer periphery with a maximum radius less than the radius of said cylindrical central bearing surface.

20. An outboard motor in accordance with claim 17 wherein said camshaft aperture in said bottom wall portion of said cylinder head has a diameter greater than said diameter of said central cylindrical bearing of said camshaft.

* * * * *